United States Patent [19]

Morey et al.

[11] Patent Number: 4,507,656

[45] Date of Patent: Mar. 26, 1985

[54] CHARACTER/VECTOR CONTROLLER FOR STROKE WRITTEN CRT DISPLAYS

[75] Inventors: William A. Morey, Marion; Ronald J. Tonneson, Fairfax, both of Iowa

[73] Assignee: Rockwell International Corporation, El Segundo, Calif.

[21] Appl. No.: 417,318

[22] Filed: Sep. 13, 1982

[51] Int. Cl.[3] ..... G09G 1/10

[52] U.S. Cl. ..... 340/739; 340/727; 340/736

[58] Field of Search ..... 340/732, 736, 739, 740, 340/741, 742, 743, 727

[56] References Cited

U.S. PATENT DOCUMENTS

| | | | |
|---|---|---|---|
| 3,821,729 | 6/1974 | Schultze | 340/727 |
| 3,824,382 | 7/1974 | Eshelman | 340/739 |
| 3,921,163 | 11/1975 | Giraud et al. | 340/739 |
| 3,962,536 | 6/1976 | Busch | 340/727 |
| 4,001,806 | 1/1977 | Sweeting | 340/739 |
| 4,032,768 | 6/1977 | Rieger | 340/739 |
| 4,095,145 | 6/1978 | Terranova et al. | 340/742 |
| 4,228,510 | 10/1980 | Johnson et al. | 340/727 |

*Primary Examiner*—Gerald L. Brigance
*Attorney, Agent, or Firm*—Richard W. Anderson; Robert C. Mayes; H. Fredrick Hamann

[57] ABSTRACT

A controller for a vector generator used in drawing vector defined symbology on the face of a cathode ray tube is disclosed. Digital storage definitive of contiguous vectors which comprise each symbol to be drawn is addressed by a character address output from a microprocessor which also outputs rotation angle data. Rotation of each segment comprising a symbol is accomplished by simple addition of predetermined most-significant bits of the rotation angle data and segment angle data addressed from storage by the microprocessor, with the summation applied as addressing input to a ROM look-up table from which sine and cosine functions of the resultant angle are obtained. The sine and cosine functions are applied as inputs to respective integrators to establish their respective rates of integration over a period of time proportional to vector length.

7 Claims, 6 Drawing Figures

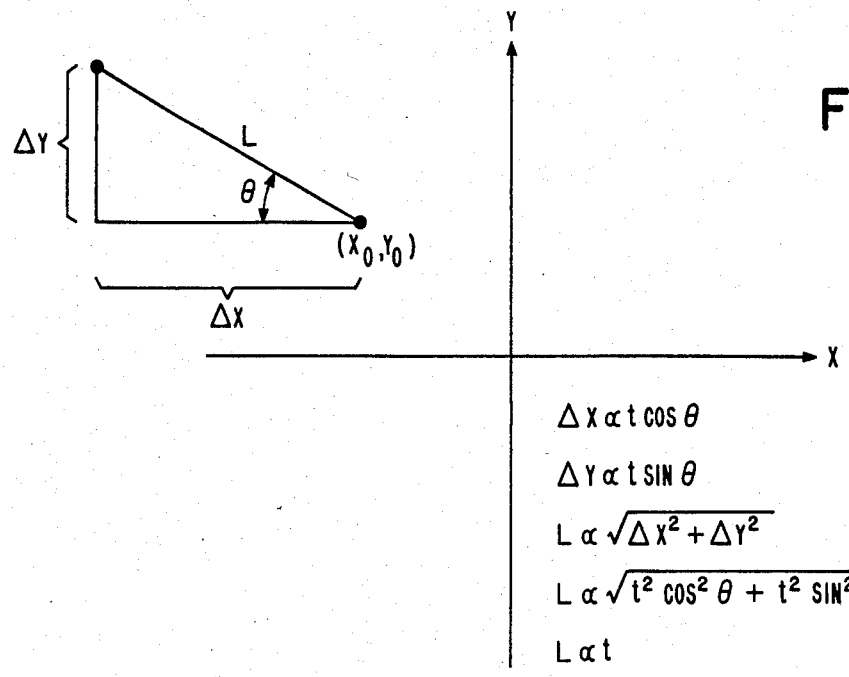

FIG. 3

$$\Delta X \propto t \cos\theta$$

$$\Delta Y \propto t \sin\theta$$

$$L \propto \sqrt{\Delta X^2 + \Delta Y^2}$$

$$L \propto \sqrt{t^2 \cos^2\theta + t^2 \sin^2\theta}$$

$$L \propto t$$

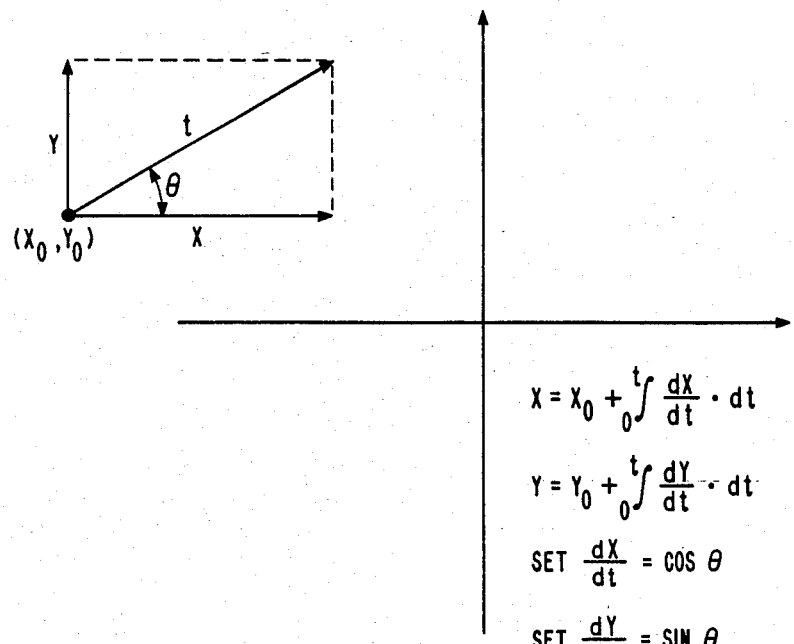

FIG. 4

$$X = X_0 + \int_0^t \frac{dX}{dt} \cdot dt$$

$$Y = Y_0 + \int_0^t \frac{dY}{dt} \cdot dt$$

$$\text{SET } \frac{dX}{dt} = \cos\theta$$

$$\text{SET } \frac{dY}{dt} = \sin\theta$$

$$X = X_0 + \int_0^t \cos\theta \, dt$$

$$Y = Y_0 + \int_0^t \sin\theta \, dt$$

CHARACTER/VECTOR CONTROLLER FOR STROKE WRITTEN CRT DISPLAYS

This invention relates generally to the art of stroke written symbology on a cathode ray tube and more particularly to a controller for use with a digital vector generator by means of which symbology may be written on the face of a cathode ray tube and rotated thereon placing minimal requirements on a microprocessor utilized to program the display sequence.

The controller to be herein described operates with a digital vector generator as described in copending application Ser. No. 417,319 entitled "Digital Vector Generator" by William A. Morey and assigned to the assignee of the present invention.

As described in my copending application, symbology may be stroke written on the face of a cathode ray tube by defining the symbology as contiguous vectors each of which is defined by a predetermined polar angle (slope) and a predetermined length. As described in application Ser. No. 417,319, a microprocessor is employed to output the sine and cosine functions of the polar angle of each vector to be written on the CRT. The microprocessor also outputs a digital control word definitive of the length of the vector. A first variable rate integrator is caused to integrate at a rate proportional to the cosine of the vector polar angle by inputting the cosine function to the integrator while instantaneously the integrator is enabled to perform its integration process for the period of time which is outputted from the microprocessor. Similarly, a further variable rate integrator is caused to integrate at a rate defined by the sine function of the polar angle of the vector to be written by inputting the sine function of the polar angle as provided by the microprocessor to an integrator and causing that integrator to integrate for a period of time as defined by the timing output from the microprocessor.

The invention to be described herein relates to a controlling arrangement for use in such a variable rate integration stroke writing system.

A system, such as defined in my copending application, depending upon the complexity of the symbology to be drawn on the face of the CRT and considering that a certain display refresh rate is desired, may place stringent and complex operational requirements on a microprocessor employed in the programming. It has been found that when attempting to use off the shelf single chip microprocessors to perform control functions for the digital vector generator of my copending application, that a desired display refresh rate might not be attained. For example, such a system might be employed to generate an electronic aircraft instrument display such as the well known horizontal situation indicator type of instrument which employs, among other things, a complete compass rose, thus requiring a considerable sequence of symbology to trace out one frame of complete display. Further, in such electronic aircraft instruments, rotation of the symbology stroke written onto the display is necessary, since, for example, the compass rose displayed on such an instrument must smoothly rotate with changes in aircraft heading. Display of aircraft attitude information on an electronic aircraft display necessitates a rotation of attitude indicating indicia. Thus, the microprocessor program can become extremely detailed and lengthy to provide a constantly updated display, and attainment of desired refresh rates may require an extremely fast microprocessor of considerable expense.

Initial solutions to the problem of refresh rate attainment in such systems would thus appear to go to the use of a faster and thus more expensive microprocessor or to go to an independent character generator and sum the deflection information from the character generator, by means of which character symbology is defined, with the vector generator. Either of these solutions leads to greatly increased component costs.

Accordingly, the primary object of the present invention is to provide a comparatively simple controller system for use with a digital vector generator of the type defined in my copending application which permits the use of a relatively simple and inexpensive microprocessor, wherein rotation of displayed vectors may be accomplished by the simple addition and subtraction of angles in the microprocessor.

A further object of the present invention is the provision of a stroke writing display system which minimizes the amount of time that a controlling microprocessor must spend outputting data to the digital vector generator, permitting the microprocessor to perform useful tasks associated with processing and getting new data ready to output to the controller during those periods of time when the controller is busy.

The present invention is featured in the provision of a low cost character/vector controller circuitry for use with a digital vector generator wherein, by storing digital data describing the various vector lengths and vector angles for various characters in a ROM, the vector angle can be summed with a desired angle of rotation, with the summation then fed to sine and cosine look-up ROMS. Digital values of sine, cosine and stroke length may then be fed to the digital controlled vector generator as described in my copending application. Control logic is provided so that the various strokes required to draw a character can be automatically sequenced to the digital vector generator.

These and other features and objects of the present invention will become apparent upon reading the following description with reference to the accompanying drawings in which:

FIG. 3 is a graphical representation depicting operating principles of the vector generator of FIG. 1;

FIG. 4 is a further graphical representation illustrating operating principles of the vector generator of FIG. 1;

The invention to be described basically solves the problem of relieving the microprocessor, as might be employed in the system of my copending application, of some of the input/output operations while adding a minimal amount of additional hardware to accomplish desired refresh rate cost. As described in copending application Ser. No. 417,319, filed 9/13/82 the system employs variable rate integrators to develop respective X and Y deflection signals for application to the cathode ray tube. The integrators are programmed to the sine and cosine of the polar angle of a vector to be generated by inputting these functions to the respective integrators and enabling the integrators for a period of time T which is definitive of the length of the vector to be drawn. The outputs from the respective X and Y integrators correspond to the rectangular coordinates which define the vector traced by the cathode ray tube beam.

In contradistinction to my copending application Ser. No. 417,319 filed 9-13-82 the microprocessor in the system to be described herein outputs digital words definitive of the polar angle of the vector to be drawn, rather than the sine and cosine functions of the vector angle. These outputs are applied to controller circuitry which includes a ROM look-up table by means of which the sine and cosine functions of the vector angle are inputted to the respective variable rate integrators of the system.

Figure 1:
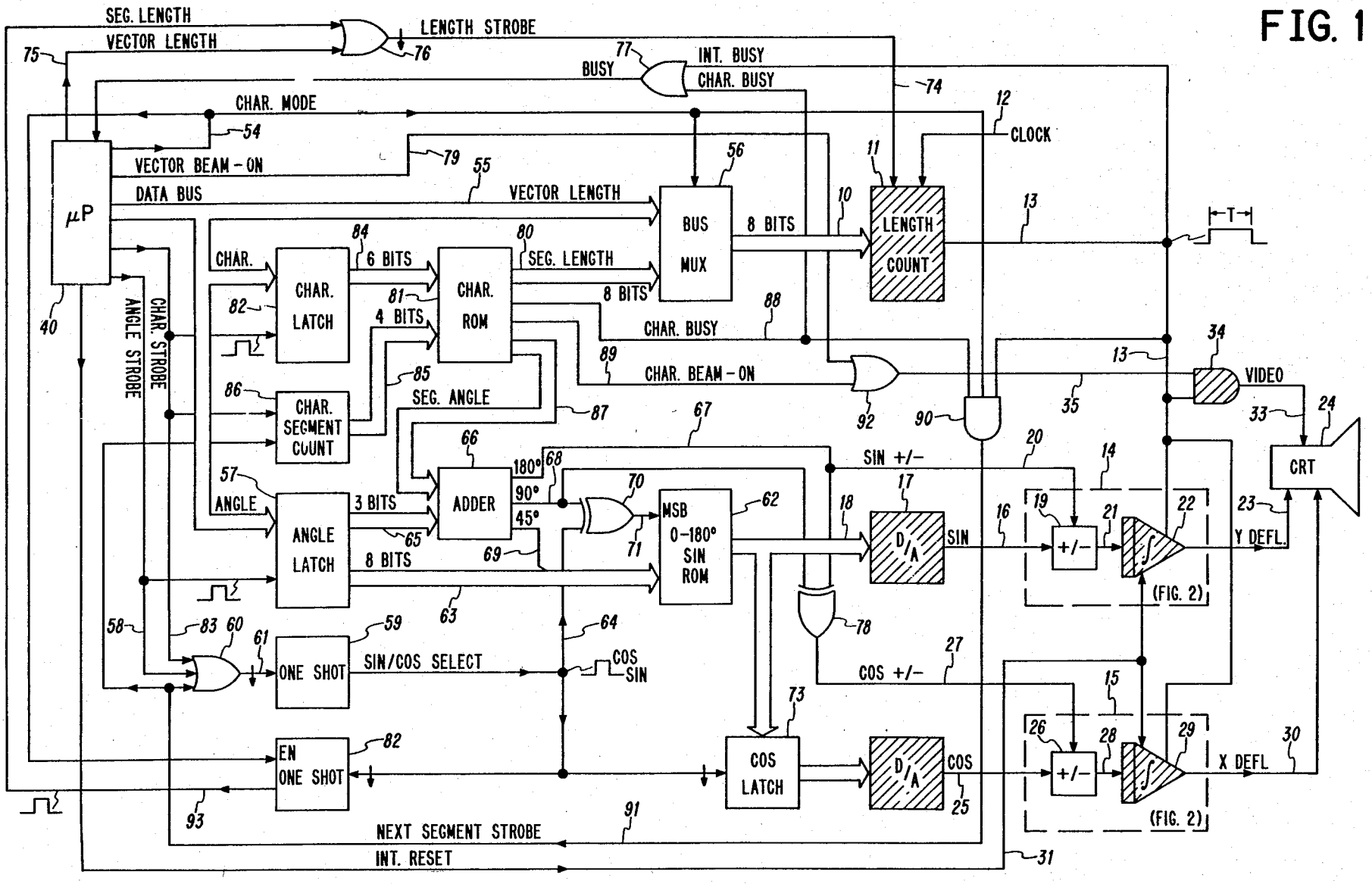
FIG. 1 is a generalized functional block diagram of the character/vector controller of the present invention as utilized with a digital vector generator employing variable rate integration to generate deflection signals effective to draw vectors and/or contiguous vector defined characters on the face of a cathode ray tube.

Referring to FIG. 1, the digital vector generator portion of the stroke writing system is depicted generally by the shaded functional blocks in the right hand portion of the figure. As described in the above referenced copending application, a digital word definitive of a vector to be drawn on the face of the cathode ray tube is inputted on a bus line 10 to a length downcounter 11 which counts down at a rate defined by clock input 12 to provide an output gate 13 the duration of which is proportional to the length of the vector to be drawn. The length counter output 13 comprises a pulse of width T which is applied to a Y deflection variable rate integrator 14 and an X deflection variable rate integrator 15 to cause these integrators to be enabled to integrate for the duration of the timing pulse T. The Y deflection variable rate integrator 14 receives an input 16 definitive of the sine of the polar angle $\theta$ of a vector to be drawn. The analog signal proportional to sine $\theta$ on line 16 comprises the output of a digital-to-analog converter 17 to which a digital input on bus 18, definitive of sine $\theta$, is applied. The analog sine $\theta$ signal on line 16 is applied to a +/− control circuitry 19 which, under the control of a sine +/− input on line 20, supplies the sine $\theta$ signal on line 16 input 21 to integrator circuit 22 with appropriate polarity as defined by the quadrant within which the polar angle $\theta$ lies. The output 23 from integrator circuitry 22 comprises the Y deflection signal which is applied to the cathode ray tube 24.

The vector length definitive timing pulse T on line 13 is similarly applied as input to an X deflection rate variable integrator 15 to enable integrator 15 during the time period defined by the vector length definitive pulse T. Variable rate integrator 15 receives a cosine $\theta$ input signal on line 25 which is applied to a +/− control circuit 26 which, under the control of cosine +/− control signal on line 27, applies the cosine $\theta$ definitive signal as input 28 to integrator circuit 29 with a polarity defined by the quadrant within which the vector polar angle $\theta$ lies. The output 30 from integrator circuit 29 comprises the X deflection signal as applied to the cathode ray tube 24.

Each of the X and Y variable rate integrators further receives an integrator reset control signal on line 31 by means of which the integrators may be reset to zero at predetermined intervals to assure integrity in the integrator outputs which may be caused by drift. Whether or not the deflection vector defined by the X and Y deflection inputs to the cathode ray tube 24 is to be displayed is determined by a video input control signal on line 33 which comprises the output from and AND gate 34 to which the vector length timing pulse 13 and a beam-on signal on line 35 are applied as respective inputs to synchronize the video with the deflection signals.

The digital vector generator circuitry thus described employs variable rate integrators which are programmed to the sine and cosine functions of the polar angle of a vector to be drawn, while the length of the vector to be drawn is defined by the length of time the respective integrators are permitted to integrate. Reference is made to FIG. 3 wherein a vector is illustrated on the face of a cathode ray tube. The vector of length L starts from a point on the face of the tube defined as $X_O$, $Y_O$. In accordance with generalized stroke writing techniques, the vector is realized by generating a Y deflection signal which may incrementally be considered as $\Delta Y$, and an X deflection signal incrementally defined as $\Delta X$. From the geometry depicted in FIG. 3, the length L of tne vector is proportional to the square root of the sum of the squares of $\Delta X$ and $\Delta Y$. If then we equate the length L of the vector as being proportional to time, we may write that $\Delta X$ is proportional to the product of time and the cosine of the polar angle $\theta$, while $\Delta Y$ is proportional to the product of time and the sine of the polar angle $\theta$. If then we express the length L in terms of the square root of the sum of the squares of t cos $\theta$ and t sin $\theta$, respectively, we see that length is proportional to time. Now referring to FIG. 4 and substituting T for the length of the vector, it is seen that the horizontal component X of the vector may be expressed as $\Delta X \alpha$ t cos $\theta$ while the vertical component of the vector may be expressed as $\Delta Y \alpha$ t sin $\theta$. If, in the above expressions, we then set dX/dT cos $\theta$ and dY/dT = sin $\theta$, the horizontal component X of the vector may be expressed as:

$$X = X_0 + \int \cos\theta \, dt$$

and the vertical component of the vector may be expressed as:

$$Y = Y_0 + \int \sin\theta \, dt.$$

The above expressions define the horizontal and vertical deflection signals as being comprised as the sum of an initial position plus the integration, over a period of time T, of either the sine or cosine function of the vector polar angle $\theta$. In operation, the initial starting points as defined by $X_O$ and $Y_O$ are provided by the inherent memory of the variable rate integrators employed in the system of FIG. 1, such that, in the case of writing a succession of contiguous vectors, for example, on the face of the cathode ray tube, the end point of any one of the contiguous vectors may comprise the starting position for the next succeeding vector such that a plurality of contiguous vectors of predetermined slope and length may be written on the face of the CRT to trace out a particular symbology.

Figure 2:
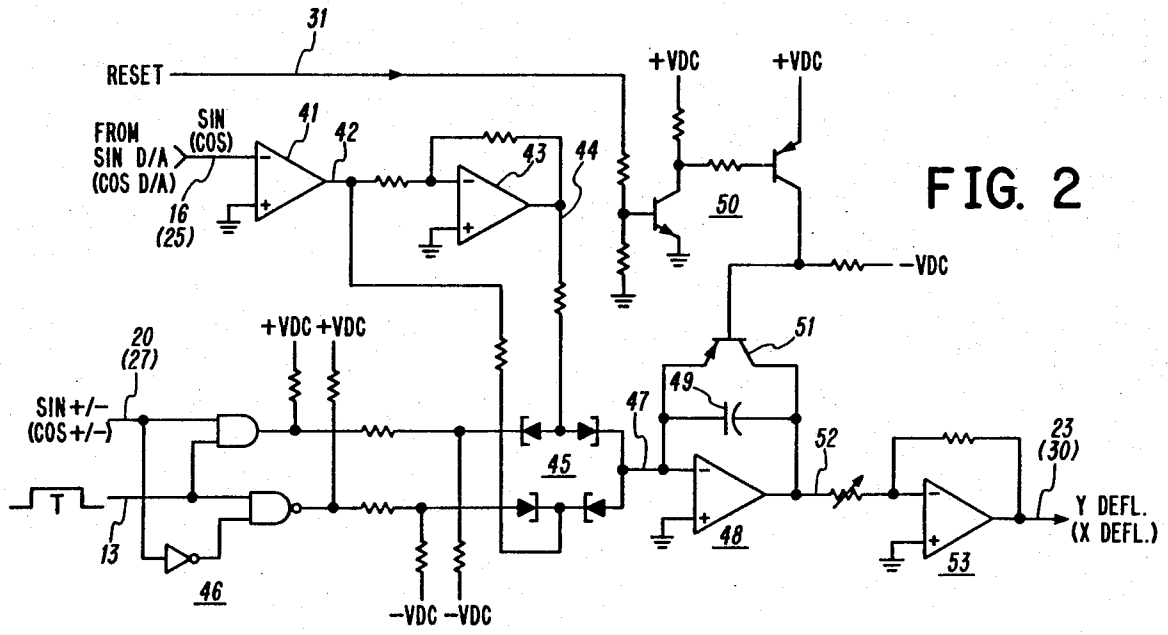
FIG. 2 is a schematic diagram of a type of variable rate integrator employed in the system of FIG. 1.

The variable rate integrators 14 and 15 in the system of FIG. 1 may be implemented as shown schematically in FIG. 2. Referring to FIG. 2, each of the integrators 14 and 15 in the system of FIG. 1 may comprise identical circuitries which operate to apply an appropriately signed input to an integrator circuit for a predetermined period of time, with provision for occasional reset of the integrator circuit output to zero as controlled by the microprocessor 40 of FIG. 1. General operation of the circuitry of FIG. 2 will be described with reference to its incorporation in the system of FIG. 1 as the Y variable rate integrator 14. With reference to FIG. 2, the output 16 from the Y digital-to-analog converter 17 is applied to an inverting amplifier 41 whose output 42 is applied to a further inverting amplifier 43, such that the respective inverting amplifier outputs 42 and 44 are respective oppositely signed signals definitive of the sine of the polar angle $\theta$. These respective oppositely signed outputs 42 and 44 are applied to a steering diode bridge arrangement 45 through which they are controllably and selectively applied as the input 47 to an integrator circuitry 49 in the form of either a positive or a negative step input proportional to the sine function of the polar angle $\theta$ of the vector to be drawn. Which one of these respectively oppositely polarized signals 42 and 44 is applied as input to the integrator 48 is controlled by the sign of the sine $+/-$ control line 20, and the time during which either of the outputs 42 and 44 is applied to the integrator 48 is determined by the duration of the time pulse 13 from length counter 11 in FIG. 1. The steering and time control function is accomplished by applying the sine $+/-$ on line 20 and the time pulse on line 13 to a logic circuitry 46 which effects selective enabling and time controlled biasing of the steering diode network 45 whereby one or the other of the resepectively oppositely polarized outputs 42 and 44 from inverting amplifiers 41 and 43 is applied as input 47 to the integrator 48 for a duration of time determined by the pulse width of the time pulse 13.

Reset of the integrator 48 in FIG. 2 is accomplished by applying the reset pulse on line 31 to a transistor control circuitry 50 which is effective in turning on switching transistor 51 to provide a low impedance shunt across the capacitor 49 associated with the integrator 48 and thus dump the integrator output 52 to zero. The output 52 from the integrator 48 is shown applied to a further inverting amplifier 53 with the output 23 from the amplifier 53 comprising the Y deflection signal that is applied to the cathode ray tube 24 of FIG. 1. Amplifier 53 provides a means by which the gain scaling of the integrators 14 (15) may be calibrated.

The circuitry of FIG. 2 is additionally utilized for the X variable rate integrator 15 in the lower right hand portion of FIG. 1. In this instance, the cosine $\theta$ analog output 25 from digital-to-analog converter 18 is applied as input to the inverting amplifier 41 of FIG. 2. The algebraic sign of cosine $\theta$ on line 27 is applied as input to the logic circuitry 46 of FIG. 2 along with the time pulse on line 13, with the output 30 from the X variable rate integrator 15 being applied as the X deflection signal to the cathode ray tube 24.

The digitally controlled vector generator portion of the system of FIG. 1, as depicted in the shaded blocks of FIG. 1, has been basically described in terms of drawing a particular vector of a given length and polar angle on the face of the cathode ray tube, having available polar angle sine and cosine values and a vector length defining time pulse. The drawing of symbology comprised of contiguous vectors necessitates that vector length information as well as sine and cosine values of the polar angle must be sequentially inputted to the digital vector generator portion of FIG. 1 in terms of digital representations of vector length to the length counter 11 and appropriately signed sine $\theta$ and cosine $\theta$ functions to the respective variable rate integrators.

As described above, when considering relatively complex symbology displays on the face of the cathode ray tube, a relatively expensive and extremely fast microprocessor may be required to accomplish writing the complex symbology at a desired refresh rate. Further, should it be desired to rotate the symbology written on the face of the CRT, the polar angles of vectors being drawn may be constantly changing such as, for example, the display of a compass rose on the face of an aircraft instrument, where the compass rose rotates in accordance with changes in aircraft heading. Accordingly, the remaining portion of the system of FIG. 1, as will now be described, acts as a character and vector controller for the digital vector generator portion above described, and permits the use of a relatively inexpensive microprocessor by relieving the microprocessor of input/output operations while adding a minimal amount of additional hardware external of the microprocessor to accomplish the end result.

In general, the controller to be described stores, in a ROM external of the microprocessor, digital data defining various segment length and segment angles for each alphanumeric character to be displayed. Circuitry external of the microprocessor 40 receives a character address for application to the external character defining ROM and control logic is provided so that the various segments required to draw a character can be automatically sequenced from the external character ROM to the vector generator.

The microprocessor, in addition to outputting character addresses, outputs an angle $\alpha$ which comprises an angle by which the complete character may be rotated. The angle of each contiguous vector (segment) comprising a character, is sequenced out of the character ROM during the drawing of a character, and added to the rotation angle $\phi$ with the summation addressing a sine/cosine ROM means from which the sine and cosine functions of the resultant polar angle $\theta$ are obtained. By limiting the polar angles of the contiguous vectors making up the characters to be displayed to integer multiples of 45°, the addition of rotation angle $\phi$ and character segment angles will be seen to be vastly simplified and require minimal and inexpensive hardware. In general, it will be seen that the controller to be described will permit the microprocessor to perform useful tasks associated with processing and getting new data ready to output to the controller during the time that the controller is busy rather than the microprocessor spending all of its time outputting data to the digital vector generator, which in general permits the use of a less expensive and slower microprocessor.

The description thus far has referred to the drawing of vectors on the face of the cathode ray tube with the vector having a predetermined length and polar angle. The drawing of characters has been briefly referred to as that of drawing contiguous vectors each having a particular assigned length and polar angle. For purposes of the ensuing discussion the term vector will be reserved for a particular mode in which long lines are desired to be drawn on the face of the screen or where the beam is to be positioned for a considerable distance from the center point of the screen to begin the drawing of a character or symbology. The drawing of characters will now be described as the drawing of a sequence of contiguous character segments, it being understood that each segment of a character comprises a line of predetermined length and polar angle with respect to orthogonal axes about which the character is oriented.

Thus the character and vector controller portion of the system of FIG. 1 has two basic operating modes; VECTOR mode and CHARACTER mode. VECTOR mode infers beam displacement along a particularly long line, and CHARACTER mode refers to the drawing of individual ones or sequences of various alphanumeric symbologies or other symbols desired to be drawn on the face of the cathode ray tube. The selection of either CHARACTER or VECTOR mode in FIG. 1 is controlled by the CHARACTER mode output line 54 from microprocessor 40. Line 54 will either be a binary 1 or a binary 0 level to effect the respective operating modes.

In the VECTOR mode, data defining the vector angle, length and beamon are provided by microprocessor 40. Data bus 55 from the microprocessor is connected through a bus multiplexer 56 to the length down counter 11 of the digital vector generator circuitry previously described. The angle at which the vector is to be drawn is provided on data bus 55 as input to angle latch 57. The VECTOR mode operating sequence begins by loading the vector angle as it appears on the data bus 55 into angle latch 57 by the angle strobe output 58 from microprocessor 54. When the angle is loaded into angle latch 57 by the angle strobe 58, a sine/cosine select one-shot 59 is triggered by the trailing edge of the angle strobe 58 as it is outputted from OR gate 60 on line 61.

A sine ROM 62 for table look-up of sine and cosine data eliminates one input output operation as concerns the microprocessor 40, since the microprocessor only has to output angle rather than sine and cosine of the angle. An additional feature of the sine ROM 62 is related to the format in which data is stored therein ROM. By storing the angle in sine ROM 62 from 0° to 180°, and defining the input address lines to sine ROM 62 to be the natural binary code of the angle, then both sine and cosine data may be obtained from the sign ROM 62 simply by inverting the most significant sine ROM address bit. Thus when the angle on data bus 55 is loaded into angle latch 57 by the angle strobe 58, the sine/cosine select one-shot 59 is triggered, which selects cosine data during the duration of the pulse generated by the sine cosine select one-shot on output line 64. It is noted that the three most significant bits of the output of the angle latch 57 as they appear on angle latch output bus 65 are applied to a three bit adder 66 and, in the absence of any further input to adder 66, appear on the adder output lines 67, 68 and 69, respectively. Now sine functions of the angle from 0° to 180° are stored in the sine ROM 62 and, with the input address lines being defined as the natural binary code of the angle, the most significant bit address input to ROM 62 is weighted at 90°. If, then, the most-significant bit of the address to ROM 62, as it appears on output line 68 of adder 66, is applied as a first input to an exclusive OR gate 70, and the output of the sine/cosine select one-shot 59 on line 64 is applied as a second input to exclusive OR gate 70, the output 71 from exclusive OR gate 70 is inverted during the presence of the output pulse from the sine/cosine select one-shot 59. This operation is the equivalent of adding 90° to the angle address as it is applied to the sine ROM 62 and $\sin(\theta+90°)=\cos\theta$. When sine/cosine select one-shot 59 is triggered by the angle strobe 58 from the microprocessor 40, cosine data appears on the output bus 18 from sine ROM 62 which is latched into cosine latch 73 on the falling edge of the sine/cosine select output line 64. While the cosine data is being thus loaded, the microprocessor 40 may be setting up to output the length of the vector to the length counter 11.

The vector length is loaded into the length counter 11 by a length strobe input 74 which is provided on vector length output line 75 from the microprocessor 40 through OR gate 76. When the microprocessor 40 loads the length data on data bus output 55 into length counter 11 through bus multiplexer 56 with the vector length strobe 74, the length counter 11 is automatically started and generates an output pulse of width T which, as previously described, is directly proportional to the vector length. This output pulse T on line 13 from the length counter is also used to signal the microprocessor 40 that the variable rate integrators in the vector generator are still moving. Thus, the output of the length counter on line 13, which comprises the pulse of time duration T, is applied as a busy signal through OR gate 77 and to the microprocessor 40 to signal the microprocessor that the integrators are still moving and therefore should not have their data altered.

Referring now to the variable rate integrators for the X and Y deflection signals, previous discussion mentioned inputting a sine +/− control input to the Y deflection variable rate integrator 14 on line 20 and a cosine +/− control input to the X variable rate integrator 15 on line 27. These functions are expeditiously and simply accomplished by utilizing the most significant angle bit (180°) on line 67 output of adder 66 to act as the polarity switching control signal for the Y deflection amplifier 14. This most significant bit output on line 67 from adder 66 is a binary 1 for angles in excess of 180° and a binary 0 for angles less than 180°, and may be used directly to provide the proper levels for effecting polarity switching of the sine $\theta$ inputs to the Y deflection amplifier 14.

Input polarity switching of the cosine $\theta$ input to the X deflection amplifier 15 in FIG. 1 via line 27 is derived by applying both the 180° bit and the 90° bit outputs from adder 66 on lines 67 and 68 respectively as inputs to a further exclusive OR gate 78, with the output 27 from exclusive OR gate 78 comprising the cosine +/− control input to the X deflection amplifier 15. For angles between 0° and 90°, the 90° output bit on line 68 is a binary 0 as well as the output on the 180° bit line 67. For angles between 90° and 180°, these two most significant bit outputs from adder 66 are of opposite polarities (90° bit is binary 1 and 180° bit is binary 0). This latter permutation holds true for the third quadrant, and that for the fourth quadrant is similar to that of the first quadrant. Thus the cosine +/− control line 27 provides the appropriate switching information for applying cosine $\theta$ values as input to the X deflection variable rate integrator of appropriate algebraic sign (polarity).

If a vector is to be drawn on the face of the cathode ray tube, the microprocessor provides a vector beam-on output 79 which is passed through OR gate 92 on line 35 to the video AND gate 34 where it is AND'ed with the integrator time pulse on line 13 to provide a video enabling signal 33 to the cathode ray tube 24 which is synchronized with the deflection signals. Should the vector mode be employed for positioning the beam to a writing starting point position on the face of the cathode ray tube, the vector beam-on output signal 79 from the microprocessor develops a video disabling output from AND gate 34.

When changing to the CHARACTER mode, the microprocessor 40 is programmed to wait until the vector generator has completed its last move command, and then the microprocessor loads the angle latch 57 via the angle strobe output line 58 from the microprocessor to the angle $\phi$ to which character or character or character strings are to be drawn. It is to be understood that the angle $\phi$ referred to here refers to a rotation angle. In the case of an angle $\phi$ equal to zero being loaded into the angle latch 57, the vector generator will draw the character or character string symmetrically oriented with respect to the horizontal and vertical axes of the cathode ray tube. In the presence of a commanded rotation angle $\phi$ the symbology displayed will be rotated accordingly.

Once a rotation angle $\phi$ is set into angle latch 57 the character/vector controller of FIG. 1 is switched via character mode line 54 from microprocessor 40 to the CHARACTER mode which, via bus multiplexer 56, connects the length counter 11 inputs 10 to the segment length outputs on bus 80 from character ROM 81 and enables the adder 66 connected between the angle latch 57 and the sine ROM 62 inputs. A segment length one-shot 82 is also enabled by the microprocessor CHARACTER mode control line 54. A character address from data bus 55 from the microprocessor may now be loaded into the character latch 82 via a character strobe output 83 from microprocessor 40. Data from the character latch output bus 84 and the output 85 from a character stroke counter 86 collectively form the address into the character ROM 81.

As will be further described, the outputs 84 from the character latch are effective to address a particular character to be drawn, and the output 85 from the character stroke counter 86 effects an addressing sequence by means of which the lengths and angles of the contiguous segments which make up a character are defined. Thus the outputs of the character ROM 81 comprise segment length definitive bits on bus 80, segment angle definitive bits on bus 87, a character busy output signal on output line 88 and a character segment beam-on signal on line 89.

Figure 5:
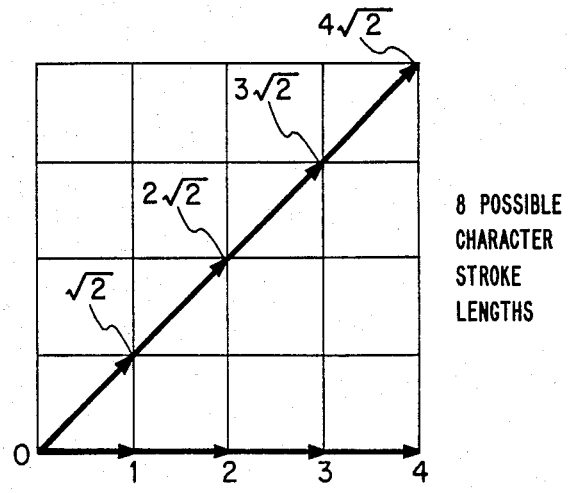
FIG. 5 is a graphical representation depicting character segment lengths employable in the system of FIG. 1.
Figure 6:
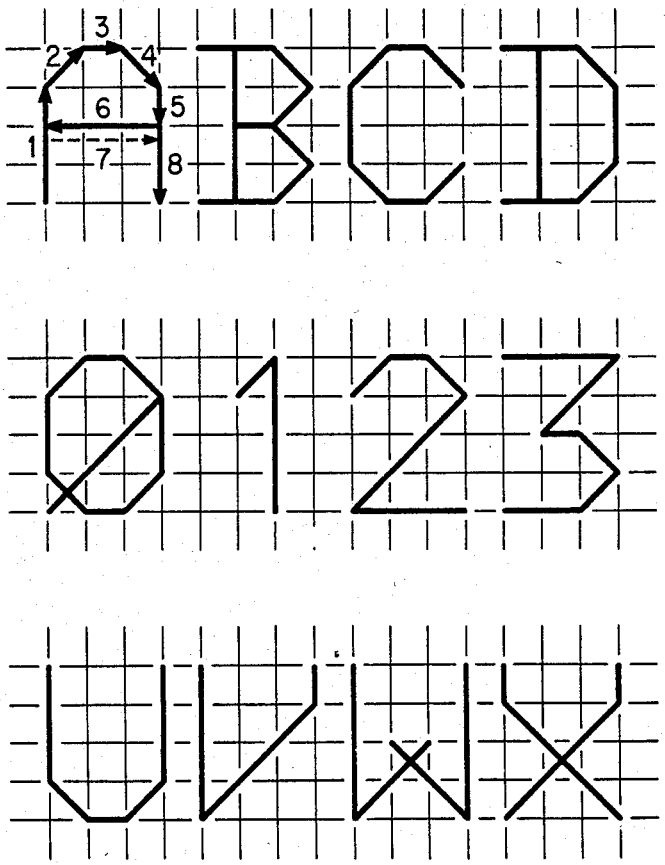
FIG. 6 depicts representative alphanumeric characters employable in the system of FIG. 1 wherein each segment of the character to be displayed has a slope which is a multiple of 45°.

The composite address to the character ROM 81 is provided jointly by the character latch 82 and the character stroke counter 86, and the particular outputs from the character ROM as indicated in FIG. 1, may best be described in terms of a defined character set. Reference is made to FIGS. 5 and 6 which illustrate a permissible set of character segment lengths and character formats.

The system is based on a 4×4 grid. With reference to FIG. 5, a 4×4 grid is depicted which illustrates eight different segment lengths permissible for any character. These lengths are indicated in FIG. 5 as being 2, 2 2, 3 2, 4 2, 1, 2, 3 and 4. It may be observed that the exampled character set depicted in FIG. 6 is made up of indivioual straight line segments whose respective lengths follow the constraints imposed by FIG. 5. As previously mentioned, the polar angle of any one segment making up a character in the set depicted in FIG. 6 is limited to an integer multiple of 45°. Thus each segment may have a polar angle of 0°, 45°, 90°, 135°, 180°, 225°, 270°, or 315°. For example, the drawing of the character A in FIG. 6 is illustrated as being comprised of eight segments. Stroke 1 is a length of three units at angle 90°, stroke two is a length of 2 at angle 45°, stroke three is a length of one and angle of 0°, stroke four is a length of 2 and angle of 315°, stroke five is a length of one and angle of 270°, stroke six has a length of three and angle of 180°, stroke seven (indicated in phantom line to denote that the CRT beam is turned off) has a length of three and an angle of 0°, and stroke eight has a length of two and angle of 270°.

Thus the output of 80 from character ROM 81 may comprise eight bits (three bits which might be internally decoded to eight bits) definitive of a vector segment length which are used to establish length counter presets definitive of the actual length of the segment and not the normalization defined by the lengths depicted in the 4×4 character grid of FIG. 5. Since, with reference to FIG. 6, the character segment angles are limited to integer multiples of 45°, eight such angles are possible, and the character ROM 81 outputs three bits of information on bus 87 to define anyone of the eight possible angles of the individual segments making up a character.

Characters may be defined by one or more 16-byte data blocks. Virtually all necessary characters could be defined with less than sixteen segments. Each of the sixteen bytes may comprise eight bits which define a character segment. These eight bits may be comprised of three bits defining the eight different possible segment lengths, three bits defining segment angle, one bit defining video on/off, and one bit defining the last segment of the character. This selection permits the circuitry for sequencing through the character segments stored in the character ROM 81 to simply be a single four-bit counter (character counter 86). By imposing the limitation that the polar angle of any character stroke is equal to N(45°), where N is an integer, the segment angle need only be stored as a three-bit word in character ROM 81, since only eight such angles are utilized.

Again it is emphasized that if the angle inputted from the microprocessor 40 to the angle latch 57 is zero, the character is drawn with reference to the cathode ray tube orthogonal axes X and Y. If the angle inputted from the microprocessor to the angle latch is some finite angle $\phi$, then each character segment is rotated by that angle $\phi$ to an angle of $[N(45°)+\phi]$. The angle $\phi$ is inputted and added to the character segment angle, N(45°). The rotation angle $\phi$ from the microprocessor may be inputted as an 11 bit binary word, giving a rotation resolution of:

$$\frac{1}{2^{11}}(360) = 0.17578°.$$

The most-significant bit of the rotation angle input $\phi$ from the microprocessor is weighted at 180°. The three most-significant bits of the rotation angle input are respectively weighted at 180°, 90°, and 45°, which are the same weightings as the three bits utilized to represent any character segment angle. Thus rotation is accomplished by simply adding the character segment angle bits from the character ROM to the three most-significant bits of the rotation angle $\phi$ set into angle latch 57 by the microprocessor, with the summation being expressed in binary form and utilized to address the sine ROM 62 from which sine and cosine inputs to the X and Y integrators are developed.

In CHARACTER mode of operation the system of FIG. 1, the character strobe on output 83 of the microprocessor 40 loads the selected character on data bus 55 into the character latch 82. Character strobe 83 also resets the character segment counter 86 and triggers the sine/cosine select one-shot 59 through OR gate 60. Tne segment angle data on output 87 of the character ROM 81 is added in adder 66 to the three most significant bits of the rotation angle in angle latch 57, which results in rotating every segment of the character by the rotation angle loaded into the angle latch. The falling edge of the sine/cosine select pulse 64 from the sine/cosine select one-shot 59 latches the cosine of the rotated character segment and also triggers the segment length one-shot 82 to generate a segment length strobe on output 93 for application through OR gate 76 to the length counter 11. The segment length strobe loads the segment length data on output 80 from character ROM 81 via bus multiplexer 56 into the length counter 11 which automatically starts the counter. In the CHARACTER mode, the integrator busy signal, which comprises the output 13 of length counter 11, is fed via AND gate 90 on line 91 into the character segment counter 86, and, via OR gate 60 into the sine/cosine select one-shot 59, so that at the end of a segment the character segment counter 86 is incremented to the next segment, and the sine/cosine data will get updated, which then loads the new segment length and starts the length counter again for the next segment. This sequence of events continues until the character busy signal on output line 88 from character ROM 81 signals the completion of the character. The integrator busy signal is then prevented from clocking via AND gate 90 the character segment counter 86. The character busy output 88 from the character ROM 81 and the integrator busy output pulse from the length counter 11 are OR'd in OR gate 77 to generate a busy signal which the microprocessor uses to determine when new data can be fed to the character/-vector controller, or when modes can be changed.

The present invention is then seen to provide a system for drawing vectors and characters on the face of a cathode ray tube by defining the vectors in terms of polar angle and length. The system employs variable rate integrations to develop the necessary X and Y deflection signals to effect the writing of vectors or contiguous vectors on the face of the cathode ray tube. In the described VECTOR mode, the microprocessor outputs vector angle and vector length. Sine and cosine of the vector polar angle are expeditiously developed by unique addressing of a sine ROM which stores sine functions for angles from 0° to 180°. By utilizing address lines for the sine ROM which represent the natural binary code of the angle, both sine and cosine data are obtained from the sine ROM simply by inverting the most significant ROM address bit. In CHARACTER operating mode, the microprocessor provides a data output definitive of a character to be drawn rather than outputs of the numerous individual vector segments which might make up that character. The definition of the character is stored in a character ROM external of the microprocessor which is addressed collectively by the character address outputted from the microprocessor and a sequencing counter which causes the character ROM to output segment length definitive data and segment angle definitive data. Rotation of any character is accomplished by rotating each character segment defining a character by a rotation angle provided by the microprocessor, and rotation is accomplished by simple addition of certain most significant bits of the character segment angle and the rotation angle. The system described removes input/output operations which would otherwise be imposed on the microprocessor, while adding a minimal amount of additional hardware thus permitting the use of a less expensive and slower microprocessor than otherwise would be dictated by the amount of symbology to be displayed at acceptable refresh rate.

Although this invention has been described with respect to a particular embodiment thereof, it is not to be so limited as changes might be made therein which fall within the scope of the appended claims.

We claim:

1. A system for drawing characters on the face of a cathode ray tube by developing respective X and Y deflection signals which collectively define a vector of selected length and polar angle, comprising:

a microprocessor providing a digital addressing output assigned to each of a plurality of characters to be drawn on the face of the cathode ray tube;

a first read-only memory means receiving said microprocessor addressing outputs and outputting a sequence of digital data bytes sequentially definitive of contiguous vectors defining that character, each said vector defining byte being defined by bits definitive of straight-line segment lengths and angles of contiguous vectors defining that character including bits defining the segment angle and a video on-off bit;

means for selectively adding to said bits defining each segment angle of a character, to obtain a summation angle, a character rotation angle outputted from said microprocessor;

means addressing a second read-only memory means to output respective sine and cosine functions of said summation angle outputted by said adding means;

means for selectively applying said sine and cosine functions from said second read-only means as respective inputs to first and second variable rate integrators;

means responsive to said straight-line segment length defining bits outputted from said first read-only memory means to output a timing signal proportional to the length of that segment;

means for enabling said integrators for the time duration of said timing signal; and means for enabling the beam of said cathode ray tube in response to said video on-off signal outputted from said first read-only memory means, wherein said integrators directly generate deflection signals.

2. A system as defined in claim 1 further including first and second digital logic means, said first digital logic means responsive to predetermined bit outputs from said adder to develop polarity definitive outputs respectively defining the polarity of sine and cosine functions of the angle defined by the output of said adder, and said second logic means responsive to the output of said first digital logic means to apply said sine and cosine definitive signals during periods of time defined by said timing signal to said variable rate integrators with respective polarities as defined by the quadrant within which the angle defined by said adder output lies.

3. The system as defined in claim 2 wherein the angles of those segments defining a character to be drawn on the face of the cathode ray tube are defined as multiples of 45°, whereby the angle defining bits outputted by said first read only memory means are respectively weighted as 180°, 90°, and 45°; said rotation angle input from said microprocessor being defined by a plurality of m bits the three most significant bits of which are weighted as 180°, 90° and 45° respectively, said adder adding the segment angle output definitive bits from said first read-only memory means with the three most significant bits definitive of said rotation angle from said microprocessor, whereby the angle defined for each successive contiguous segment defining a character to be displayed is rotated by the angle defined by said rotation angle input from said microprocessor, and means for addressing said second read-only memory means with the output of said adder.

4. The system as defined in claim 3 wherein said second digital logic means is responsive to the most significant bit output of said adder to develop a binary output level effective to apply said outputted sine definitive signal from said second read-only memory means to said first variable rate integrator with a polarity defined by the quadrant within which the polar angle of that vector lies, further comprising third digital logic means being responsive to the most and next-most significant bit outputs from said adder to develop a binary output level to said second digital logic means effective to apply said outputted cosine definitive signal from said second read-only memory means to said second variable rate integrator with a polarity defined by the quadrant within which that polar angle lies.

5. The system as defined in claim 4 wherein said second digital logic means comprises an exclusive OR gate.

6. The system as defined in claim 4 wherein said second read-only memory means comprises a sine function look-up read-only memory, the outputs from said adder comprising a binary number collectively defined by the 90° and 45° weighted bits from said adder and successive lesser significant bits of the rotation angle inputted from said microprocessor, said sine look-up read-only memory having stored therein respective digital words definitive of sine functions of angles from 0° to 180° with the most significant bit weighted at 90°; and means responsive to each successive binary address inputted to said second read-only memory means to sequentially address said second read-only memory means with the address defined by the summation of the bit outputs from said adder and inputted rotation angle, said second read-only memory means in response to addressing inputs thereto outputting sine functions of the angle so addressed, means for inverting the most significant address bit to said second read-only memory means whereby the output from said second read-only memory means comprises the cosine function of the angle so addressed, and means for sequentially applying said sine and cosine function outputs from said second read-only memory means as respective inputs to said variable rate integrators.

7. The system as defined in claim 6 wherein said means for inverting the most significant bit of the address to said second read-only memory means further comprises:

an exclusive OR gate receiving a first input comprising the second most significant output bit from said adder;

a second input to said exclusive OR gate comprising the output from a one-shot multivibrator;

means for triggering said multivibrator to output a pulse of predetermined time duration as each successive character segment angle defining bit sequence is outputted from said first read-only memory means, the pulse output of said one-shot multivibrator being effective in inverting the output from said exclusive OR gate during the time duration thereof; and means responsive to the falling edge of the output from said one-shot multivibrator to latch the output from said second read-only memory means into a digital latch the output of which comprises the cosine function of the angle of the vector being drawn, the output from said second read-only memory means, exclusive of the time duration of the pulse output from said one-shot multivibrator, comprising the sine function of the angle of the vector being drawn.

* * * * *